US006254517B1

(12) United States Patent
Kennedy

(10) Patent No.: US 6,254,517 B1
(45) Date of Patent: Jul. 3, 2001

(54) MULTIPLE EXERCISE DEVICE

(76) Inventor: Robert D. Kennedy, 107C Third Avenue, Ottawa, Ontario (CA), K1S 2J7

( * ) Notice: Subject to any disclaimer, the term of this patent is extended or adjusted under 35 U.S.C. 154(b) by 0 days.

(21) Appl. No.: 09/438,580

(22) Filed: Nov. 12, 1999

(51) Int. Cl.[7] ..... A63B 21/055
(52) U.S. Cl. ..... 482/121; 482/142; 482/130
(58) Field of Search ..... 482/111, 112, 482/130, 140, 142, 121

(56) References Cited

U.S. PATENT DOCUMENTS

| | | | | |
|---|---|---|---|---|
| 4,720,099 | * | 1/1988 | Carlson | 482/130 |
| 5,393,286 | * | 2/1995 | Cheng | 482/130 |
| 5,407,414 | | 4/1995 | Bass . | |
| 5,603,681 | | 2/1997 | Olschansky et al. . | |
| 5,716,308 | | 2/1998 | Lee . | |
| 5,720,701 | | 2/1998 | Truini . | |
| 5,720,702 | | 2/1998 | Lee . | |
| 5,800,323 | | 9/1998 | Ansel . | |
| 5,895,343 | | 4/1999 | Huang . | |
| 6,120,421 | * | 9/2000 | Koo | 482/111 |

* cited by examiner

*Primary Examiner*—Jerome W. Donnelly
(74) *Attorney, Agent, or Firm*—Nixon Peabody LLP

(57) ABSTRACT

A multiple exercise device comprising an elongated support bar extending from side to side, to be supported on a surface such as a pad support extending away from a central portion of the bar and similarly positioned to be supported on the surface, a pair of elongated arms pivotably secured at spaced locations on the bar to pivot in the longitudinal direction of the bar, a bearing bar secured to another end of each arm and oriented so as to extend towards the support pad in parallel fashion to the bearing bar on the other arm and tensioning means extending between the arms and the support bar, in adjustable fashion, to provide adjustable resistance to the pivoting motion of each of the arms. The exerciser of the present invention has a simple, compact construction which provides a multiplicity of exercises to be performed with a minimum of adjustment.

3 Claims, 4 Drawing Sheets

MULTIPLE EXERCISE DEVICE

FIELD OF THE INVENTION

The present invention relates to an exercise device, and more particularly to a simple, lightweight device which permits a number of different exercises to be carried out.

BACKGROUND OF THE INVENTION

DESCRIPTION OF THE RELATED ART

Many devices intended to provide a variety of exercises are described in the prior art. Of particular interest is U.S. Pat. No. 5,716,308 of Lee issued Feb. 10, 1998, which describes an elevated bench support having, at opposite ends, pivoting members tensioned by means of an elastic chord. The pivoting members permit only limited movement and thus limiting the number of exercises permitted is limited.

Simpler exercisers containing a single lever arm, pivoting at a position located a distance above abase, are described in U.S. Pat. No. 5,603,681 of Olschansky et al, issued Feb. 18, 1997, U.S. Pat. No. 5,720,702 of Lee issued Feb. 24, 1998 and U.S. Pat. No. 5,895,343 of Huang issued Apr. 20, 1999, the first of these being associated with a floor supported base pad, the other two being associated with a wall mountable base support.

U.S. Pat. No. 5,720,701 of Truini, issued Feb. 24, 1998, describes and illustrates an exercise device comprising a pair of lever arms secured to each other so as to pivot about an intermediate pivot point against a bias created by a plurality of resilient elements extending between posts positioned on each arm. Door or wall mounted exerciser devices featuring single, tensioned lever arms are described and illustrated in Bass, U.S. Pat. No. 5,407,414 issued Apr. 18, 1995, and Ansel U.S. Pat. No. 5,800,323 issued Sep. 1, 1998.

All of these prior art devices are, relatively speaking, complicated in construction and restricted in the number of exercises which they can permit a user to perform.

It is therefore a primary object of the present invention to provide a lightweight, portable, lightweight exercise device intended to provide muscle development exercises for the legs and hips (inner thigh, outer thigh), abdominal/stomach muscles, arm and chest muscles and buttocks. It is a further object of the present invention to provide such a device which is both simple in construction and easy in operation, both to adjust to different exercises and also to use when carrying out a particular exercise. It is a further object of the present invention to provide such a device which folds up into a small space for easy storage.

SUMMARY OF THE INVENTION

In accordance with the present invention and the foregoing objects, there is provided a multiple exerciser device comprising an elongated support bar extending from side to side, to be supported on a surface such as a floor, and a pad support extending away from a central portion of the bar and similarly positioned to be supported on the surface. A pair of elongated arms are secured at one end thereof at spaced locations on the bar to pivot in the longitudinal direction of the bar. A bearing bar is secured to another end of each arm and oriented so as to extend towards the pad support in parallel fashion to the bearing bar on the other arm. Tensioning means extend between the arms and the support bar, in adjustable fashion, to provide adjustable resistance to the pivoting motion of each of the arms.

In a preferred embodiment of the present invention each arm is telescopically adjustable in length and the lower end of each elongated arm is pivotably secured to a collar, the collar being mounted on the support bar. It is also preferred that the tensioning means for each arm comprises a resistance band releasably securable to a selected one of a plurality of retaining devices spaced along the bar and to a retaining device on the corresponding arm, whereby the resistance band provides a predetermined amount and direction of tensioning with respect to the side to side pivoting movement of the corresponding arm and its bearing bar during operation of the device.

The exerciser of the present invention has a simple, compact construction which permits a multiplicity of exercises to be performed with a minimum of adjustment.

BRIEF DESCRIPTION OF THE DRAWINGS

These and other advantages of the invention will become apparent upon reading the following detailed description and upon referring to the drawings in which.

Figure 1:
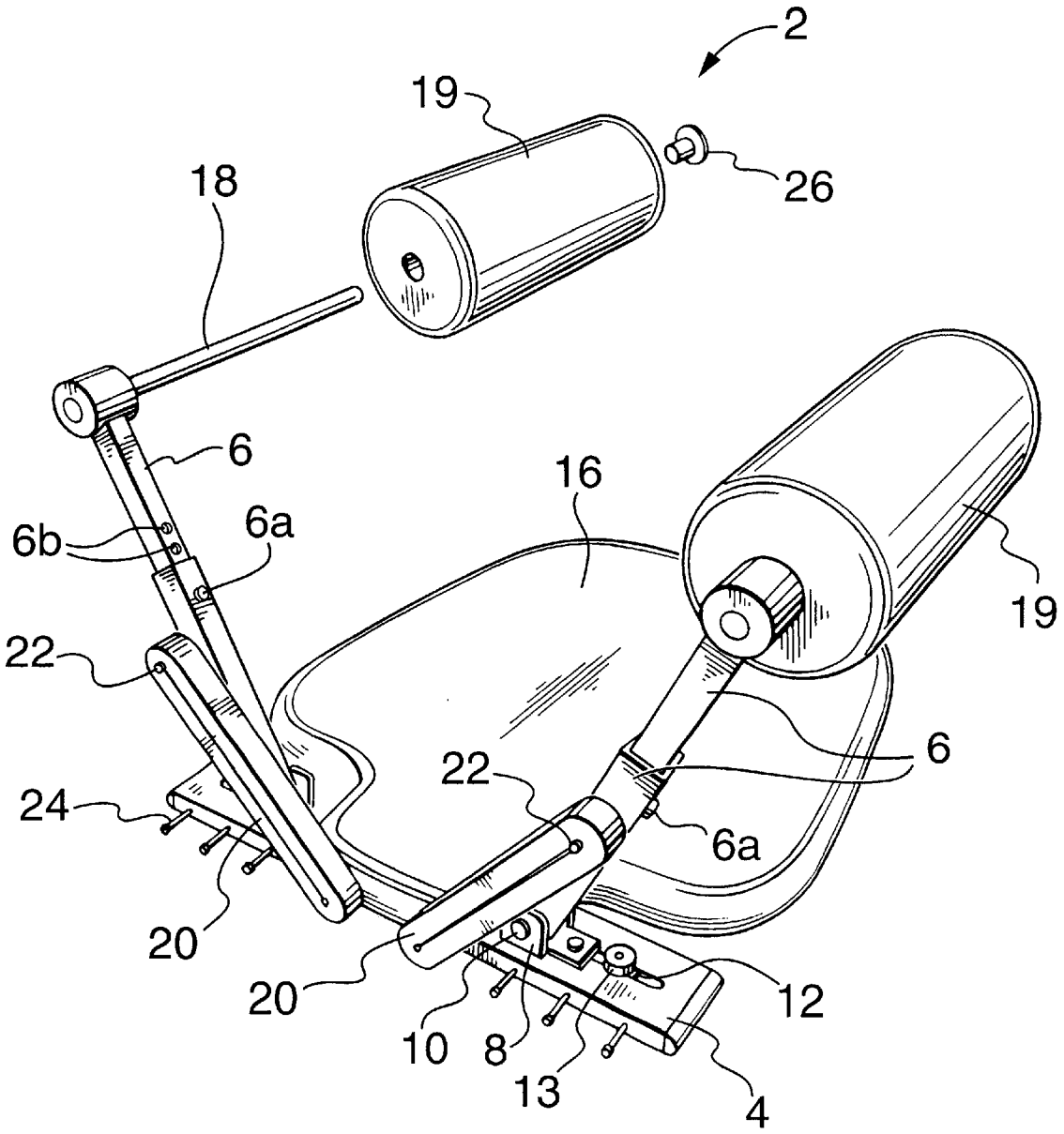
FIG. 1 is a perspective view, partially exploded, of the exercise device according to the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
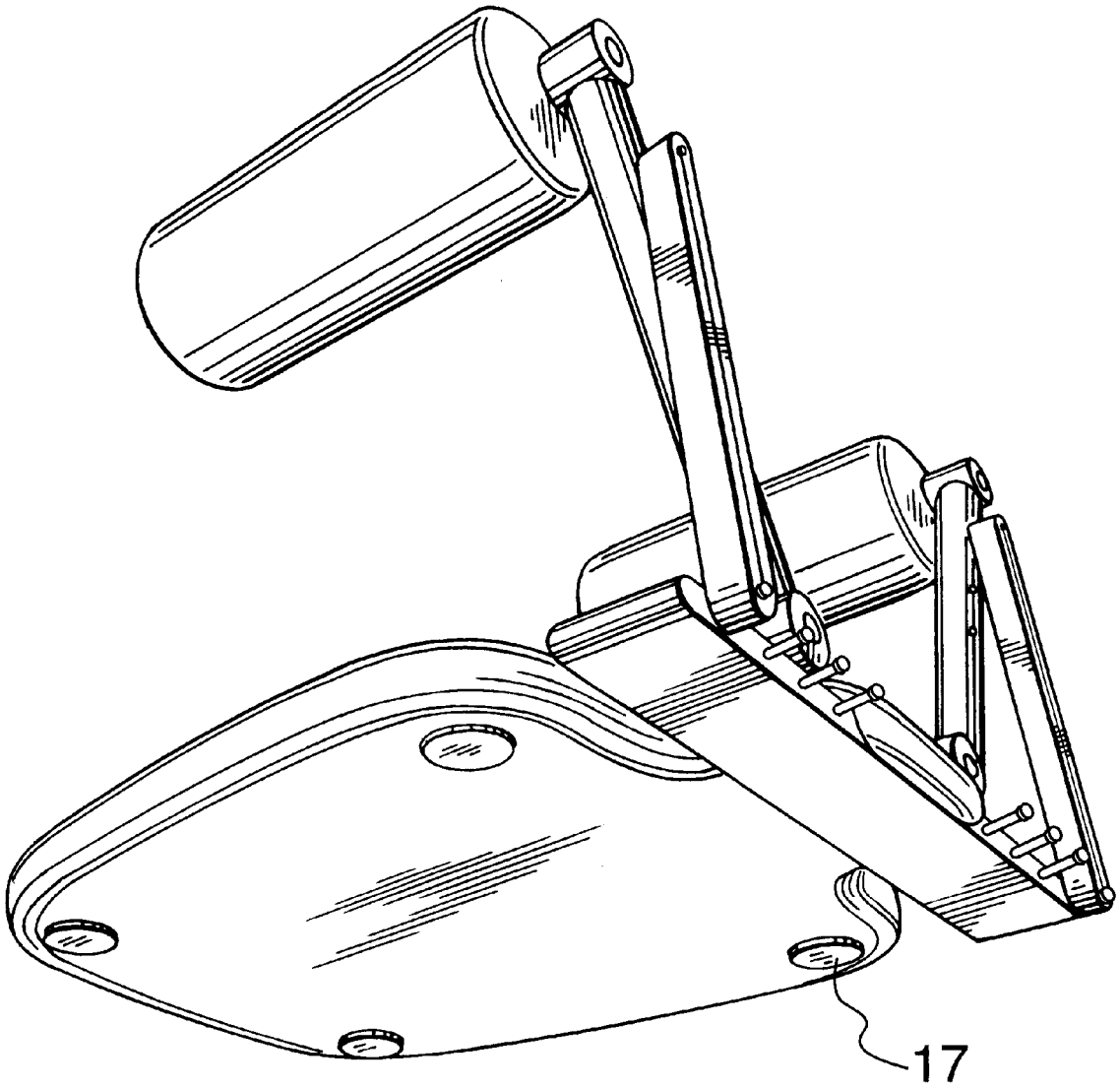
FIG. 2 is a perspective view, from below, of the device of FIG. 1 with the tension means for the lever arms in different locations for different exercises.

Turning to FIGS. 1 and 2 there is illustrated a multiple exercise device 2 in accordance with the present invention. The device comprises an elongated support bar 4 on which are mounted a pair of elongated lever arms 6. Arms 6 may be telescopic (FIG. 1) or unitary (FIG. 2). Mounted on bar 4 in either fixed or slidable fashion are collars 8 which pivotably receive and secure pins 10, located at the lower ends of arms 6, for pivotal movement of the arms in the longitudinal direction of the bar about a range of approximately 180°. In the illustrated embodiment, each collar 8 and associated pin 10 are slidably positionable from a central portion as illustrated in FIG. 1, to an outer position along support bar 4, for instance by means of an anchor 12 with a conventional securing means 13 to secure anchor 12, pin 10 and collar 8 at any desired location along this run on support bar 4. Alternatively arms 6 may be pivotally secured at fixed, appropriately spaced locations to bar 4.

A cushioned pad support 16, as can be seen in FIG. 2, optionally having rubber feet 17 or a support frame (not illustrated), may be provided, centrally positioned with respect to support bar 4 and extending sideways as illustrated. Pad 16 is preferably secured to support bar 4 and the support frame (if provided).

At the upper end of each of arm 6, extending at about a 90° angle to that arm and from the support bar 4, is a bearing bar 18 on which a suitable pad, such as cushion 19 is provided. As can be seen, arms 6 are telescopic in construction, allowing their lengths to be adjusted as necessary, for example by means of a pin 6*a* on the lower arm 6 releasably fitting into one of a plurality of apertures 6*b* in the upper arm 6, to suit the size of the user and the type of exercise being performed. Bars 18 and their associated cushions 19 are parallel to each other and, when the device 2 is supported on a floor, remain parallel to the floor during use of the device.

Directional tensioning of arms 6 and the cushioned bearing bars 18 is achieved, during operation of the device, by tensioning means such as elastic bands 20. Alternative tensioning means such as rubber tubing, springs, hydraulic cylinders etc. may be used. A retaining device in the form of a post 22 is secured to the exterior side of each arm 6, and a plurality of retaining devices in the form of posts 24 are spaced along a corresponding side of bar 4, as illustrated. It will be understood that by wrapping a particular band 20 about post 22 and a predetermined post 24, depending on the spacing of those posts from each other, the tensioning on band 20 can be increased or decreased for pivoting movement of the associated arm 6. If a post 24 which is outside of the positioning of collar 8 and pin 10 on support bar 4 is selected for band 20 for the associated arm 6, then arm 6 and bearing bar 18 will be biased in an outward direction, so that the user will have to expend energy to move bar 18 inwardly. Conversely, if a post 24 is selected on support bar 4 inwardly of the selected positioning of collar 8 and pin 10 for the corresponding arm 6, then band 20 will provide an inward bias on arm 6 and bearing bar 18 which must be overcome for outward movement thereof.

It will be understood therefore that by appropriate positioning of each band on the retainer posts of the corresponding arm and the inward or outward location of the corresponding retainer post on support bar 4, a variety of bias directions and strengths acting on one or both of arms 6 and bearing bars 18 can be achieved resulting in a great variety of exercise possibilities for the device.

The wide range of exercises which may be carried out using the device 2 in accordance with the present invention is illustrated in FIGS. 3 to 7.

Figure 3:
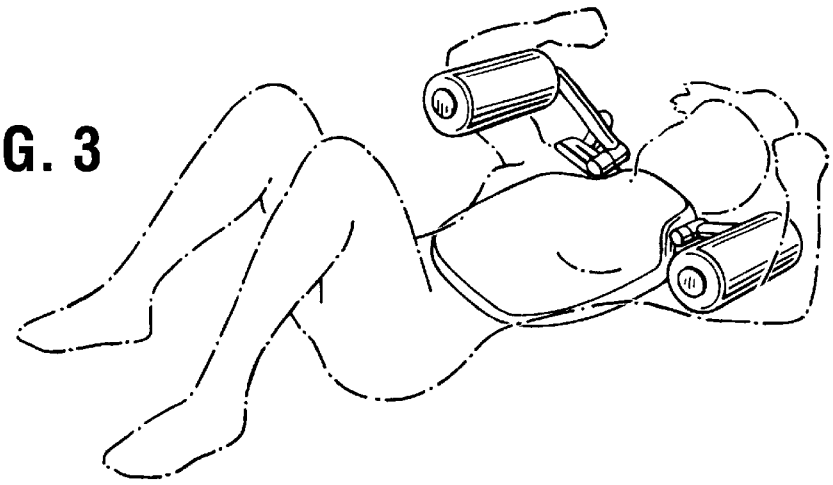
FIGS. 3, 4, 5, 6 and 7 are views of the device, in operation (with the user in phantom) illustrating the device of FIGS. 1 and 2 arranged for, and carrying out, exercises for respectively, arms and chest (FIG. 3), outer thighs (FIG. 4), inner thighs (FIG. 5), buttocks (FIG. 6) and abdominals and stomach muscles (FIG. 7).

FIG. 3 illustrates a chest exercise being carried out using the device 2 of the present invention, for developing pectoral and arm muscles. In this case each resistance band 20 for corresponding arm 6 is positioned about an outer retaining post 24 with respect to arm 6 to provide outward bias on bearing bars 18 and cushions 19. Cushions 19 are positioned so that they are in the crooks of the elbows (e.g. as illustrated in FIG. 2). This may require lateral adjustment of the positioning of each (if telescopic) arm 6 (if slidably adjustable), on support bar 4, or adjusting of the length of each arm 6. The exerciser lies on her back with knees slightly bent so that the back is flat against support pad 16. The exerciser then moves both arms in a semi-circular motion until they are almost touching over the chest, pauses, then returns slowly to start position.

Figure 4:
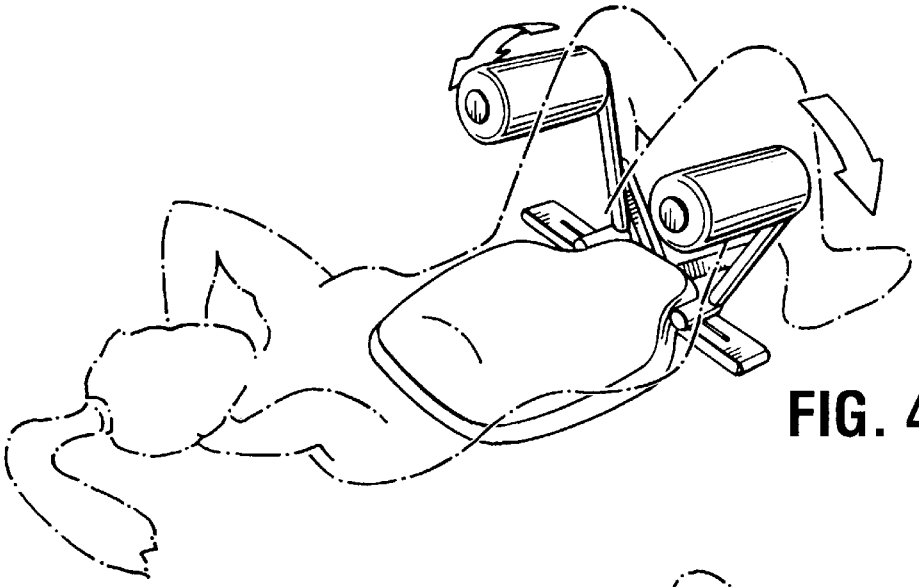

FIG. 4 illustrates the device 2 arranged for outer thigh exercise to develop the outer quadriceps, thigh and gluteal muscles. In this case, the user sits or lies on her back, with her knees together so that the cushions 19 are positioned outside of her knees. The knees may also be bent so that they are in a more comfortable position. The resistance bands 20 are secured to retaining posts 24 which are positioned, along support bar 4, inside of the positioning of pin 10 and collar 8, for each corresponding arm 6 (e.g. as illustrated in FIG. 1). The anchor 12 may have to be slidably positioned and secured in a more outward location along slot 14, for each arm 6, to enable this exercise to be carried out. The arms 6, bearing bars 18 and cushions 19 are inwardly biased, requiring pressure to force them outwardly. The exerciser then pushes her knees and thighs outwards so that she feels the outside of her thighs tighten up, pauses with knees and thighs apart, then returns to start position.

Figure 5:
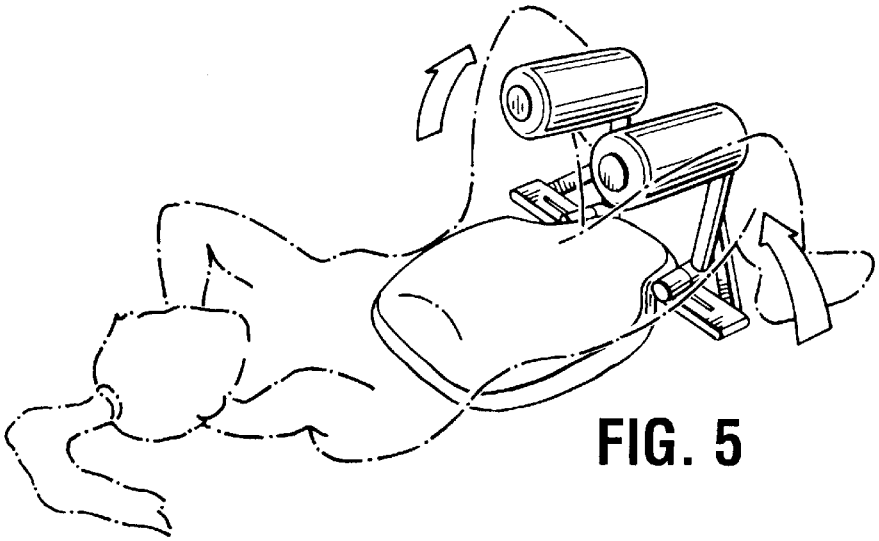

In FIG. 5, the exercise device 2 is configured for an inner thigh exercise to develop the inner quadriceps, thigh and gluteal muscles. Tensioning bands 20 are secured on outer posts 24, with respect to the positioning of corresponding arms 6 on support bar 4 (e.g. as illustrated in FIG. 2) so that an outward biasing is on arms 6. Again the positioning of the lower ends of arms 6 may be adjusted, along support bar 4, to accomplish this exercise. In this exercise, the user is sitting or laying on her back and brings her knees together so that the cushions 19 are inside of her knees. The user then pulls her knees and thighs together slowly so that she feels the inside of her thighs tighten up, pauses with knees together, then returns to starting position.

Figure 6:
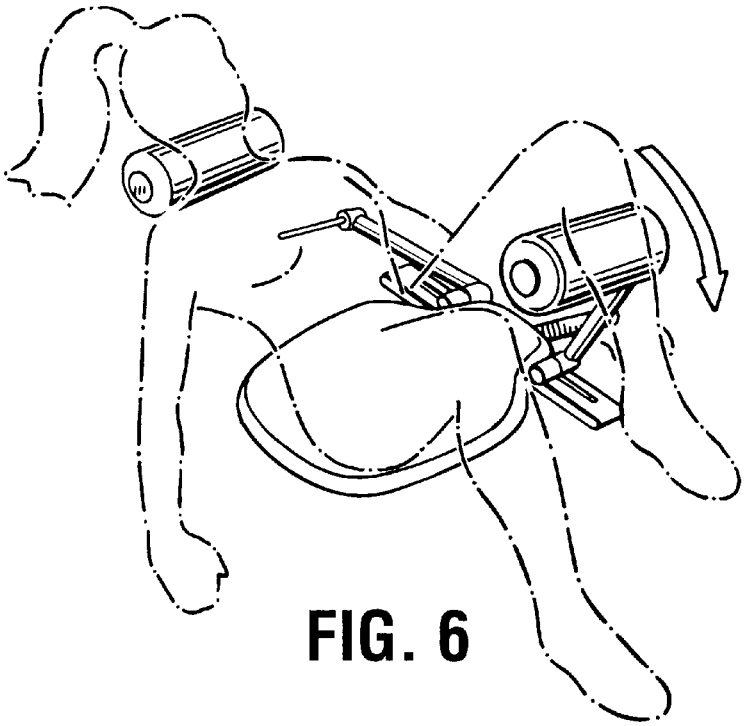

FIG. 6 illustrates the configuration of the device 2 for exercising the hamstring and gluteal muscles. In this case the elastic band on one arm 6 is completely removed, and the user either lies parallel to the support bar on the pad so that her back is flat against the floor (as illustrated) or is in a seated position on pad 16. The cushion 19 of the other arm 6 is positioned (using the telescopic feature of the arm) so that it is in the crook of the user's knee, while nearest the support bar 4, while the other leg is fully extended. The band 20 for the operative arm 6 is secured over an internal retaining post 24 (with respect to corresponding collar 8 of arm 6) providing an inward bias to arm 6 and bearing bar 18. The user then brings that leg and cushion 19 as far back towards her as possible, then pushes that leg and the cushion 19 away and, against the bias of band 20 as far as possible and then, pauses keeping the legs straight, knees together and toes pointed the exercise is then repeated. This exercise then should be repeated with the other leg, the user turning around 180° on pad 16, and the other arm 6 being activated with its corresponding band 20, in a similar fashion, with the original arm 6 being disabled.

Figure 7:
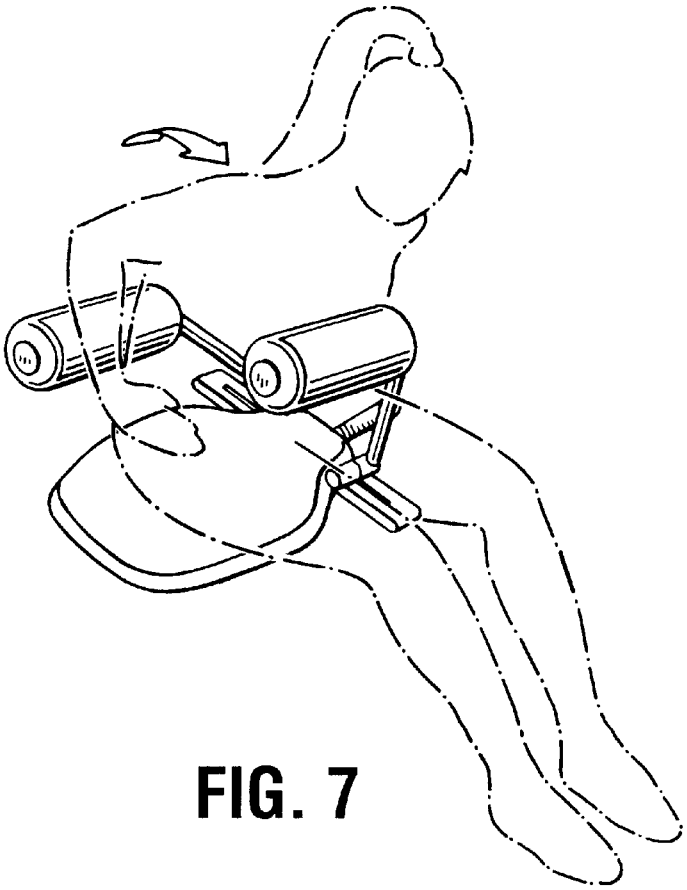

In FIG. 7, device 2 has been arranged for exercising the user's abdominal muscles. In this case the band 20 from one of arm 6 has been completely disabled and the other band 20 for the other arm 6 has been positioned on an inner retainer post 24 along support bar 4 to provide inward bias on arm 6 and cushion 19. In this case, in a sitting position, the user places cushion 19 in front of her chest (adjusting the length of arm 6 as required) with her hands at her side. The upper body (chest) is moved forward and down making sure that her abdominal muscles are contracted. When in the down position, she pauses when contracting muscles, then returns slowly to the starting position.

It will be appreciated that other exercises may be done using the device in question and its many different arrangements based on placing of the bands 20 on corresponding posts 22 and 24, and adjusting the positioning of the anchors 12 and the lengths of arms 6.

It will be further understood that the device according to the present invention is small, lightweight and collapsible into a very compact storage position by removing cushions 19 held on bars 18 by caps 26, and bands 20 to enable the arms 6 and bearing bars 18 to fall into a position more or less at the same level as cushion 16 and bar 4. The device according to the present invention is easily adaptable for a wide variety of exercises. The user merely has to reposition her body relative to the system and can perform the required exercise movements.

Thus, it is apparent that there has been provided in accordance with the invention an exerciser device that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A multiple exercise device comprising an elongated support bar extending to be supported on a surface, a pad support extending away from a central portion of the bar and similarly positioned to be supported on the surface, a pair of elongated arms, each telescopically adjustable and pivotally secured at one end to the support bar, the arms being pivotable over a range of about 180°, a cushioned bearing bar secured to the other end of each arm and oriented to extend towards the support pad in parallel fashion to the bearing bar on the other arm, and tensioning means extending between the arms and the support bar, in adjustable fashion, to provide adjustable resistance to the pivoting motion of each of the arms, the tensioning means for each arm comprising a resistance band releasably securable to a retaining device located on the base and to a selected one of a plurality of retaining devices spaced along the corresponding arm, whereby the resistance band provides a predetermined amount and direction of tensioning with respect to pivoting movement of the corresponding arm during operation of the device.

2. A device according to claim 1, wherein a lower end of each elongated arm is pivotably secured to a collar being slidably secured to the support bar so as to slide along a run from a central position to a remote position on the bar, and locking means being provided to releasably lock the collar in a selected position along its run.

3. A device according to claim 1, wherein the resistance bands are rubber bands.

* * * * *